US005819441A

United States Patent [19]

Perrissoud

[11] Patent Number: 5,819,441

[45] Date of Patent: Oct. 13, 1998

[54] BOOT WITH UPPER FLEXION CONTROL

[75] Inventor: Claude Perrissoud, Saint-Jorioz, France

[73] Assignee: Salomon S.A., Metz-Tessy, France

[21] Appl. No.: 625,863

[22] Filed: Apr. 1, 1996

[30] Foreign Application Priority Data

Apr. 19, 1995 [FR] France ..... 95 04859

[51] Int. Cl.[6] ..... A43B 5/04

[52] U.S. Cl. ..... 36/118.2; 36/117.1; 36/119.1

[58] Field of Search ..... 36/117.1, 118.2, 36/118.3, 118.4, 119.1

[56] References Cited

U.S. PATENT DOCUMENTS

| | | | |
|---|---|---|---|
| 4,078,322 | 3/1978 | Dalebout | 36/117 |
| 4,447,970 | 5/1984 | Delery | 36/121 |
| 4,677,771 | 7/1987 | Arieh et al. | 36/120 |
| 4,910,892 | 3/1990 | Perrissoud | 36/118.3 |
| 4,932,143 | 6/1990 | Benetti | 36/120 |
| 5,088,211 | 2/1992 | Walkhoff | 36/118.2 |
| 5,353,528 | 10/1994 | Demarchi | 36/121 |
| 5,564,204 | 10/1996 | Cagliari et al. | 36/118.2 |

FOREIGN PATENT DOCUMENTS

| | | | |
|---|---|---|---|
| 0056774 | 7/1982 | European Pat. Off. . | |
| 0206394 | 12/1986 | European Pat. Off. . | |
| 0241840 | 10/1987 | European Pat. Off. . | |
| 0368797 | 5/1990 | European Pat. Off. . | |
| 0378966 | 7/1990 | European Pat. Off. . | |
| 2498061 | 7/1982 | France . | |
| 2498431 | 7/1982 | France . | |
| 8020898 | 11/1980 | Germany . | |
| 4202788 | 8/1992 | Germany | 36/118.2 |

*Primary Examiner*—Paul T. Sewell
*Assistant Examiner*—Anthony Stashick
*Attorney, Agent, or Firm*—Greenblum & Bernstein P.L.C.

[57] ABSTRACT

The invention relates to a ski boot including a first element or shell base overlaid by a second element or upper provided with a flexion control device having a shock absorbing element cooperating between the upper and the shell base. A transmission arm connects the top portion of the upper to the shell base via a shock absorbing element inserted between at least one of its ends and the opposing wall of the constituent element of the boot. The transmission arm transmits all of the pivoting forces of the boot with respect to the shell base directly to the shock absorbing element due to its attachment by its two ends to these elements of the boot, and forces the shock absorbing element, sandwiched between the arm of the element, to operate in shearing.

22 Claims, 3 Drawing Sheets

BOOT WITH UPPER FLEXION CONTROL

BACKGROUND OF THE INVENTION

1. Field of the Invention

The present invention relates to rigid shell ski boots including a shell base overlaid by an upper that is at least partially pivotal. The invention also relates to a flexion control device adapted to elastically absorb the forces applied by the lower portion of the skier's leg that are applied on the upper and force it to pivot with respect to the shell base and to ensure its elastic return to the initial position as soon as the forces cease.

2. Description of Background and Relevant Information

Known boots of the aforementioned type, as described in U.S. Pat. No. 4,078,322, for example, are generally provided with flexion control devices capable of absorbing forces applied by the lower part of the skier's leg on the latter over a certain amplitude of pivotal movement of the upper. These flexion control devices generally use deformable elastic means working in compression and/or flexion and which, when released, restore sufficient energy to bring the boot back to its initial position.

In light of the amplitude of pivotal movement of the upper with respect to the shell base that is necessary for obtaining a progressive and flexible, therefore comfortable, shock absorption, the most commonly used elastic means are springs made of metal, such as steel. Indeed, steel can withstand substantial deformation and reassume its initial form quite accurately, whether it had been bent, stretched, compressed or twisted a number of times. On the contrary, steel springs are oxidation sensitive. Therefore, they require protection or treatment and they present risks of an ill-timed fracture, particularly following shocks or in the case where their maximum permissible compression is exceeded.

Moreover, conventional metal springs are difficult to integrate into boots without encumbering the volume and/or cost thereof. It is particularly the case when they are designed in specific shapes to be inserted in the general volume of the boot shell as described, for example, in French Patent Publication No. 2 498 431.

For issues related to cost, volume, ease of use and insensitivity to oxidation, elastic means made of elastically compressible materials of the elastomer type are also used as springs. For example, German Patent Document No. 80 20 898 and French Patent Publication No. 2 498 061 disclose ski boots in which the flexion control devices utilize elements made out of elastically compressible material such as elastomer, i.e., a viscoelastic material. These elements are inserted with some play between the walls of the upper and the shell base, and are they maintained in translation between two abutments located in the heel zone, at a distance from the journal axis and the upper on the shell base. Thus, when the upper pivots on the shell base under the effect of the forces exerted by the lower part of the skier's leg and/or the ski, the elastic element is compressed between the two abutments and increases in volume in the transverse direction by filling more or less the entire space in which it is confined. As soon as the pivoting forces cease, the elastic element relaxes and brings the upper back to its initial position with respect to the shell base, thus ensuring the "elastic return" function.

These flexion control devices are relatively satisfactory. However, they have the disadvantage of necessitating, on the one hand, a special protection to avoid infiltration of water, snow, etc., in the housings of their elastically compressible elements and, on the other hand, of providing reinforcements on the portions that are contiguous thereto. Indeed, these elastic elements, when compressed, ensure the retention of the upper of the boot in forward pivoting. In so doing, they completely fill the space where they are confined and thus tend to deform the walls of the upper and of the shell base that are contiguous thereto. Furthermore, if water and/or snow infiltrates into their housings, the possible pivoting of the upper is disturbed because the elastic elements can no longer be compressed completely since a portion of the available space is occupied by the water and/or snow.

Another disadvantage, due to the structure of all the flexion control devices whose shock absorbing element is located in the heel zone, is related to the poor transmission of forces and/or supports of the lower part of the skier's leg from the top of the upper to the shock absorbing element. Indeed, since the shock absorbing element is located at a significant distance from the top of the upper and the journal axis thereof, a large portion of the forces and supports coming from the lower part of the skier's leg is diffused in the wall of the upper, from its upper edge to its journal axis, then up to the heel zone before biasing the shock absorbing element. As a result, this structure of the flexion control devices does not make it possible to transmit the biases directly and instantaneously but rather delays them, causing a fairly long response time, which is disturbing for the skier.

Boots are also known which comprise rubber-like and thin elastic shock absorbing elements that are sandwiched between the walls of the upper and of the shell base to absorb vibrations, shocks, etc., i.e., all of the displacements of very low amplitude. These shock absorbing elements notably reduce the brief forces but do not enable a progressive pivoting with an amplitude at least sufficient to allow for a flexion that can be perceived by the skier. In fact, such elements do not control the flexibility of the upper.

Other ski boots are provided with elements that have a certain viscosity and are inserted between the upper and the shell base to absorb the shocks and vibrations. Unlike the elastic shock absorbing elements, these viscous elements, that likewise absorb shocks and vibrations of low amplitude, enable the pivoting of, the upper by constituting what is referred to as a viscous friction. On the contrary, they are incapable of bringing the boot upper back to the initial position as soon as the forces and/or the forces cease. In fact, these devices only manage a sliding friction from one surface to another.

SUMMARY OF THE INVENTION

The present invention proposes to overcome the disadvantages of the aforementioned flexion control devices in a simple and efficient manner guaranteeing both a low amplitude absorption for the brief shocks and vibrations, and a progressive absorption of large amplitude for the biases and forces maintained with return to initial position as soon as the latter cease. The invention also proposes a very perceptible device that is capable of transmitting the forces applied on the upper portion of the upper immediately and directly to the shock absorbing element.

An object of the invention is achieved by providing a shock absorbing element made of a very thick viscoelastic material that is inserted between the upper and the shell base and caused to work in shearing rather than in compression, by means of a transmission arm that cooperates directly between the top of the boot upper and the shell base via the shock absorbing element, the periphery thereof being provided to be totally cleared to enable its transverse deformation.

The ski boot includes a first element or shell base overlaid by a second element or upper provided with a flexion control device adapted to absorb the supports of the lower part of the skier's leg over a certain pivoting amplitude of the upper with respect to the shell base. The flexion control device has an elastically deformable shock absorbing means that cooperates between the upper and the shell base. The flexion control device is constituted by a transmission arm and a shock absorbing element that is obtained in a viscoelastic material having the form of a very thick block with two approximately parallel surfaces, the transmission arm extending from the top of the upper to the shell base which it connects between them by means of the shock absorbing element sandwiched by its surfaces between at least one of its ends and the opposing boot constituent element.

Due to this structure, the forces applied on the top of the upper are transmitted directly to the shock absorbing element which, sandwiched between the end of the transmission arm and the shell base or the upper, is forced to work in shearing. Its substantial thickness and elastic characteristics determine the shock absorbing conditions, especially in amplitude and in progressiveness, as well as the force of elastic return to the initial position as soon as the forces cease.

The boot upper is thus suspended elastically around its pivoting axis on the shell base in forward and rearward flexion, its movement amplitude being essentially a function of the shearing elastic deformability of the shock absorbing element.

Preferably, the shock absorbing element is located in the lower portion of the upper in the heel zone, and the transmission arm, which is elongated, extends substantially parallel to the wall of the shell base, one of its ends being rigidly fixed to the upper portion of the upper whereas the other end, which is free and spaced from the wall of the shell base, is connected thereto by means of the viscoelastic shock absorbing element.

According to a preferred construction mode, the transmission arm is generally shaped like a "T" whose upper end, constituted by the horizontal bar, is fixed on both sides of the dorsal zone and center of the upper, whereas the lower end, ending the vertical bar, is connected to the shock absorbing element.

An improvement to this construction mode comprises providing, on the lower portion of the upper in the heel zone where the lower end of the traction arm extends, an enveloping edge adapted to mask the shock absorbing element, and under which the end of the traction arm slides through an opening.

According to an embodiment, the movement amplitude of the flexion control device is limited in the direction of a rearward pivoting from a predetermined angular position by means of one abutment interacting between the upper and the shell base.

According to another embodiment, the amplitude of movement of the flexion control device is limited in rearward and forward pivoting by means of at least one abutment interacting between the upper and the shell base.

BRIEF DESCRIPTION OF THE DRAWINGS

Other characteristics and advantages of the invention will be better understood upon reading the description that follows and with reference to the annexed drawings giving, by way of example, two embodiments thereof.

DETAILED DESCRIPTION OF THE PREFERRED EMBODIMENTS

Figure 1:
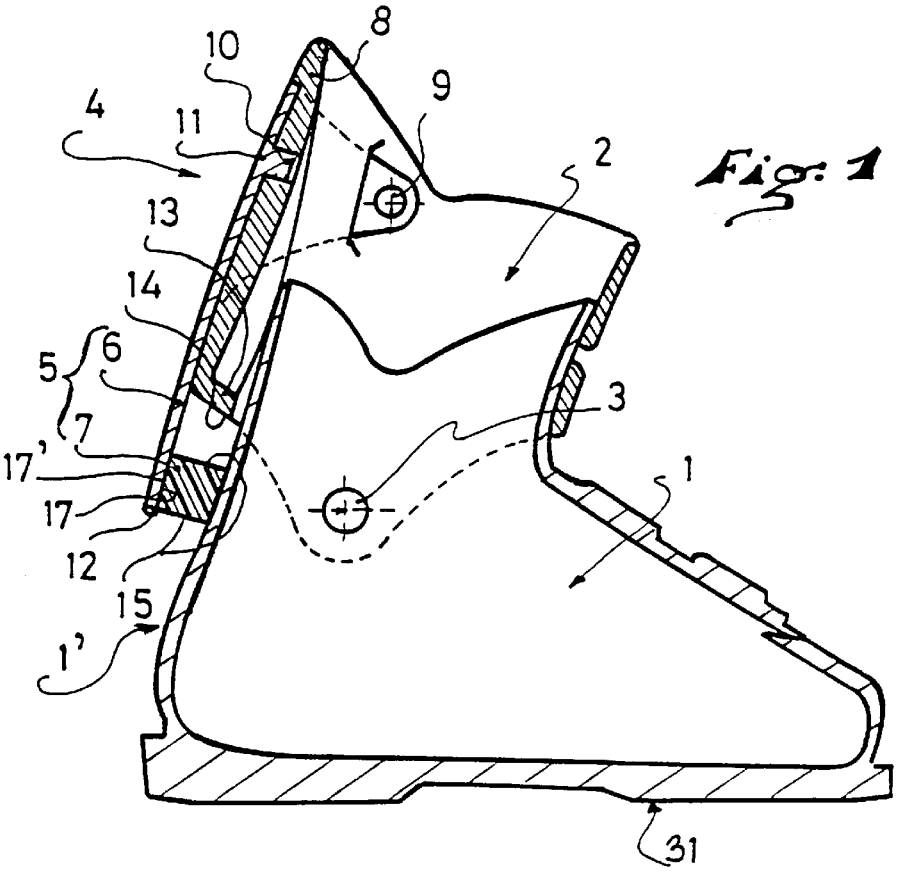
FIGS. 1 and 2 show a ski boot whose upper is provided with a flexion control device in which the viscoelastic shock absorbing element operates in shearing, FIG. 1 schematically showing a longitudinal cross-sectional view of the boot, and FIG. 2 showing rear view of the boot.
Figure 2:
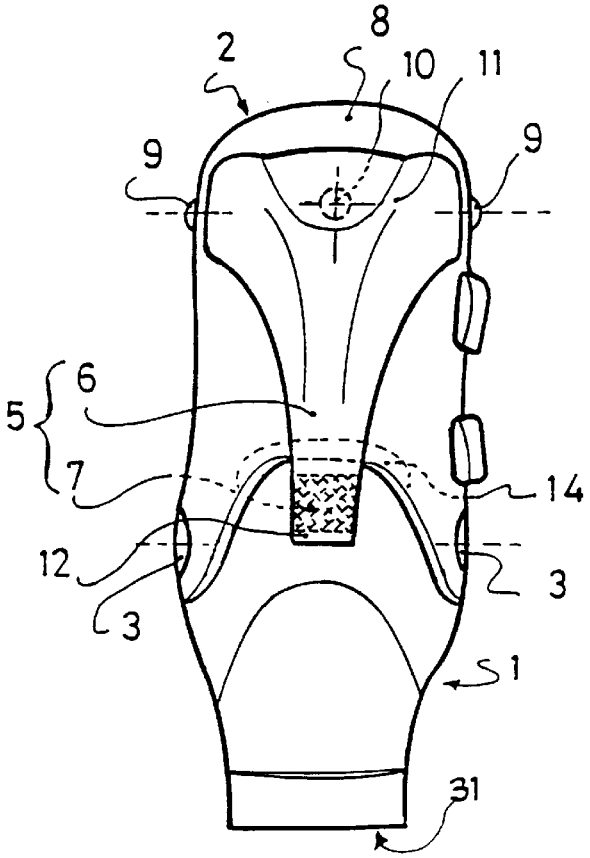
Figure 3:
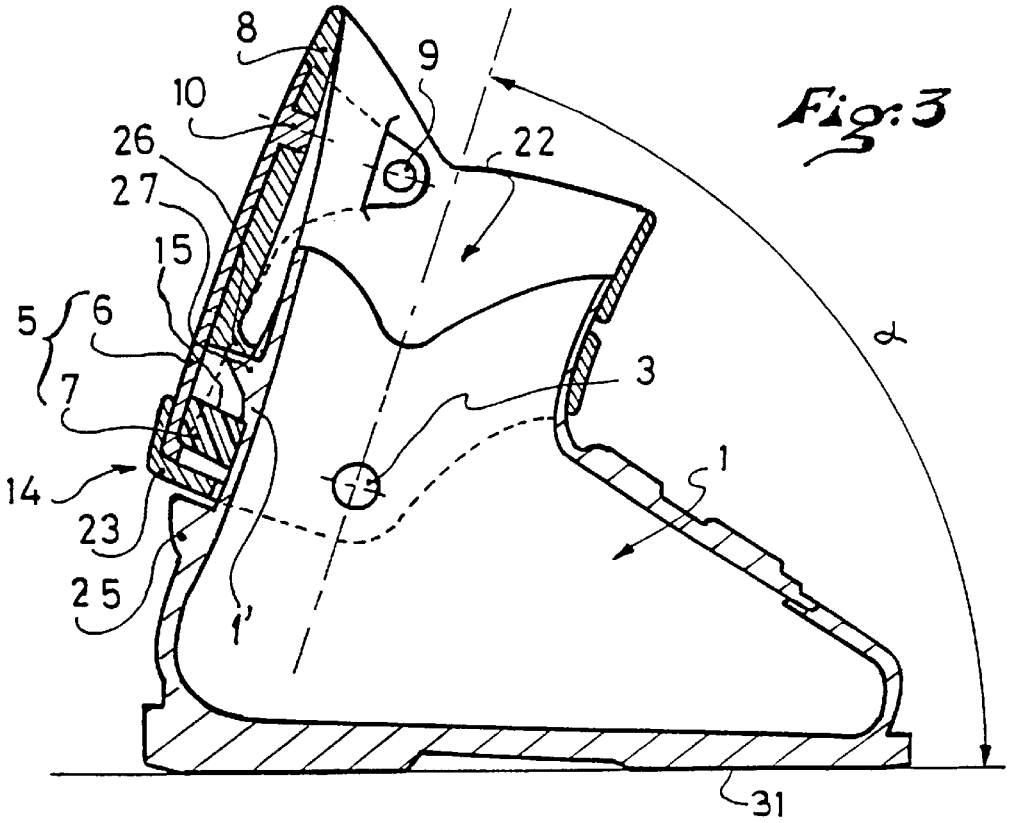
FIGS. 3, 4, 5, and 6 show another ski boot with a flexion control device of the type of that of the boot of FIGS. 1 and 2, cooperating with at least one abutment for limiting the amplitude of movement of the upper, and provided with an edge for enveloping the shock absorbing element, FIGS. 3 and 4 being longitudinal cross-sectional views of the boot, and FIGS. 5 and 6 being exterior elevational and rear views, respectively.

The ski boot includes a first element, such as a shell base 1, provided with a sole 31 overlaid by a second element, such as an upper 2, mounted at least partially pivotal on axes 3, the boot having a flexion control device 5 in the dorsal zone 4 of the upper 2. This device 5 is constituted by a transmission arm 6 affixed to the top portion 8 of the upper 2, and by a shock absorbing element 7 made of a viscoelastic material interacting between the upper 2 and the shell base 1 through the inserted transmission arm 6. The latter, which is elongated and comparable to a "T", for example, as is visible in FIG. 2, is fixed by its upper end 11 on both sides of the dorsal zone 4 of the upper 2, at reference numeral 9, and by its center 10. It extends substantially parallel to the wall 1' of the shell base 1, and its other end 12, which is free and spaced from wall 1', is connected thereto by means of the shock absorbing element 7.

The shock absorbing element 7 has the shape of a very thick block that is fixed by two opposing surfaces 17 preferably substantially parallel on corresponding binding zones 17', one of which is located on end 12 of the transmission arm 6, and the other on the wall 1' of the shell base 1.

In light of the substantial thickness of the shock absorbing element 7, the upper 2 is advantageously provided with a transverse edge 13 in its rear lower portion 14. This edge 13 is adapted to ensure the sealing between the wall of upper 2 and the wall 1' of shell base 1 which is covered in the corresponding zone.

To enable shearing deformations of the shock absorbing element 7, transversely to its binding zones 17', its periphery 15 is totally cleared or exposed from attachment to other structural elements of the boot, and the transverse edge 13 is sufficiently spaced from the binding zone 17' located on the wall 1' of shell base 1 to allow for a rearward rocking of the upper 2, at least within the elastic limits of the shock absorbing element 7. This arrangement makes it possible to avoid any accumulation or infiltration of water, snow, etc., between the shock absorbing element 7 and any one of the constituent portions of the boot which carries it, the upper 2 or the shell base 1. Moreover, as the shock absorbing element 7 operates in shearing, the clearance obtained on its periphery 15 prevents the element 7 from being confined and/or constrained against one of the walls of the upper 2 and/or of the shell base 1 or between abutments, and does not thus require reinforcements to be provided.

As a result of this construction, upper 2 is elastically suspended around its pivoting axes 3, any frontward and/or rearward movement causing the simultaneous and direct deformation of the shock absorbing element 7. Indeed, since the arm is fixed to the top portion of the upper 2, any bias applied thereon is transmitted instantaneously, and practically without any loss, to the shock absorbing element 7, which considerably reduces the response time. The skier thus benefits from a flexion control device 5 that is progressive, shock absorbing over a large amplitude, insensitive to infiltration of water, snow, etc., capable of returning the upper 2 to the initial position as soon as the biases cease, and very perceptible by the skier.

In the embodiment shown in FIGS. 3, 4, 5 and 6, the boot includes a flexion control device 5 that is associated with an upper 22 with limited clearance in the direction of a rearward pivoting from a predetermined angular position by means of an abutment 26–27. This abutment is constituted by an edge 26 provided on the wall of the shell base 1, above the binding zone of the shock absorbing element 7, and by a complementary edge 27 provided on the wall of the upper 2. This abutment 26–27 blocks the upper 22 in rearward pivoting in a predetermined angular position, with an angle a, with respect to the plane of the sole 31 of shell base 1. In this way, the skier can take a rearward support on upper 22 with the lower portion of his or her leg while being maintained along a constant angle of inclination a commonly referred to as an "advance angle", without biasing the shock absorbing element 7 which, in this case, does not operate in shearing but in flexion toward the front 28 of the upper 22.

Figure 4:
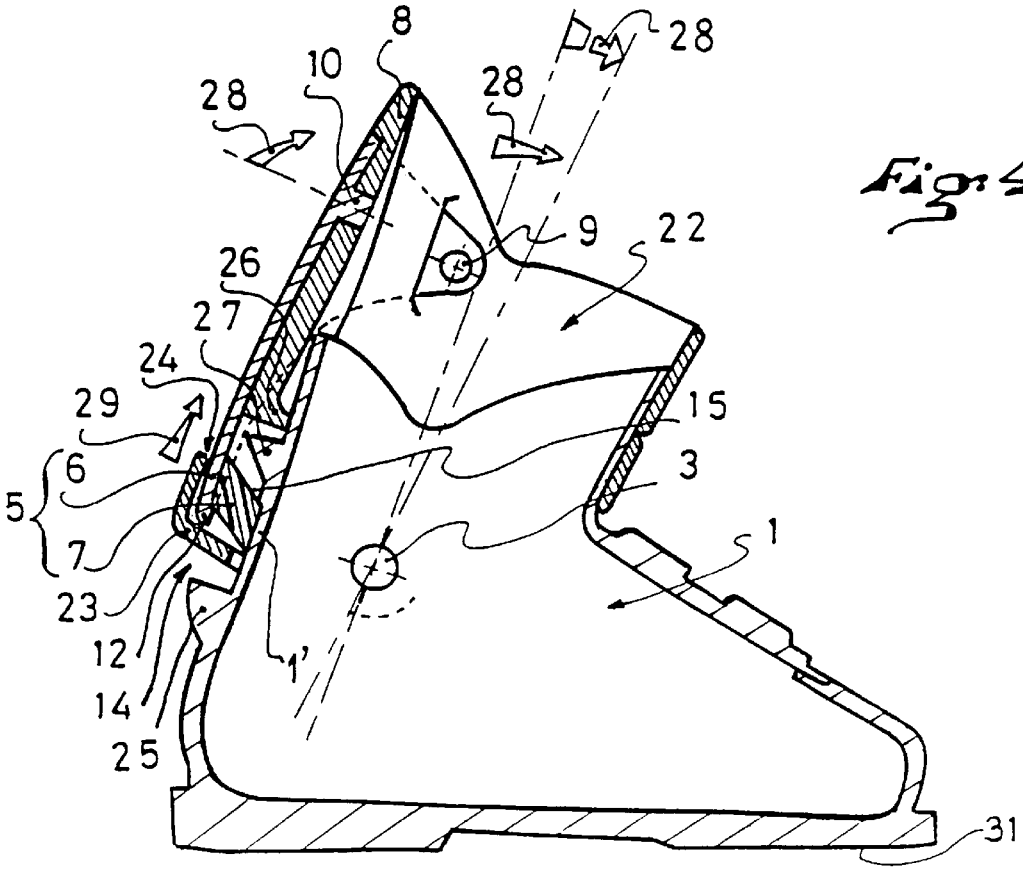
Figure 5:
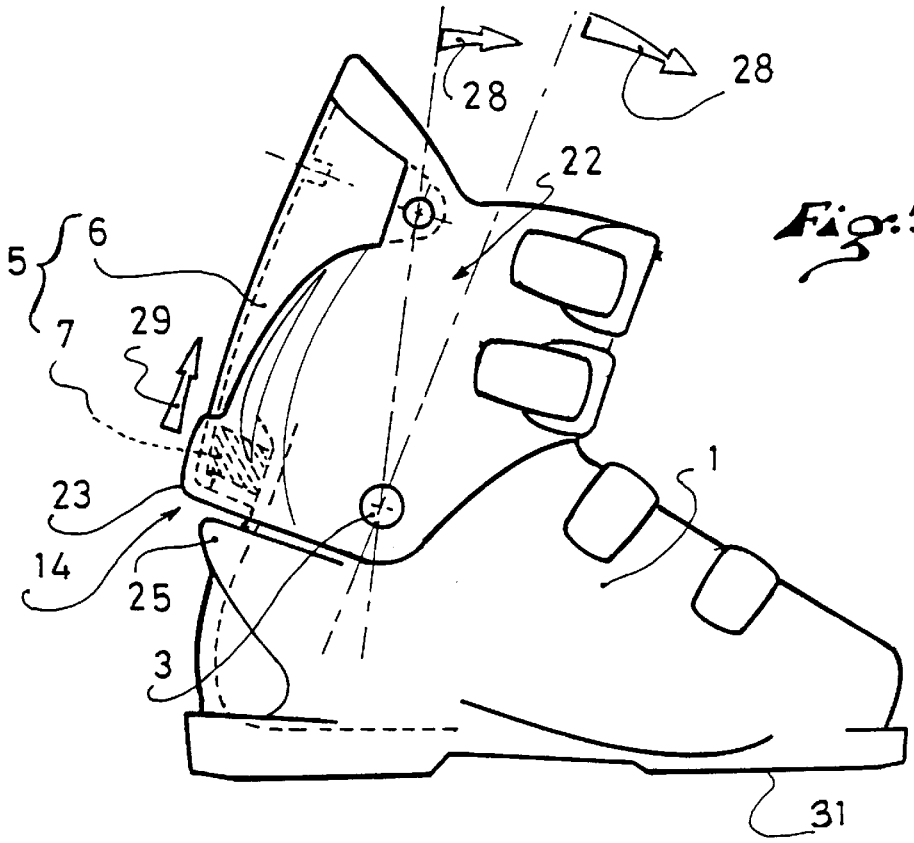
Figure 6:
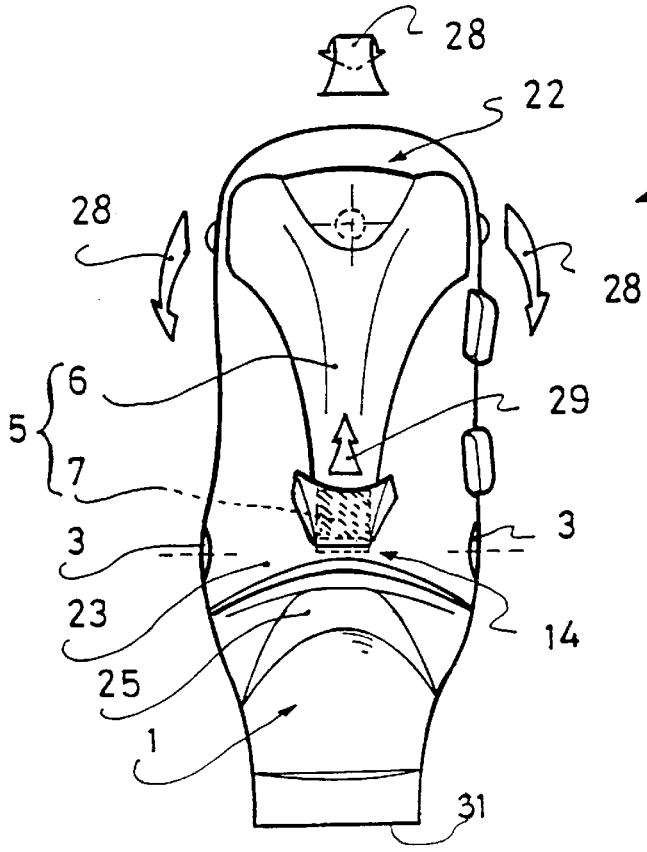

As shown in FIG. 4, in particular, one can see that flexion in the direction of arrow 28 by pivoting about its axes 3 causes, simultaneously and in the same direction 28, the displacement of the attachment points 9 and 10 of the transmission arm 6. (Since the latter is connected to the shock absorbing element 7 by its lower end 12) the pivoting movement along in the direction results in a longitudinal displacement 29 of the end 12 which forces element 7 to operate transversely to its binding zones.

Advantageously, the upper 22 is provided with an enveloping edge 23 in its rear lower portion 14. This edge 23 advantageously covers the entire shock absorbing element 7 while leaving its periphery free and is provided with an opening 24 through which the free end 12 of the transmission arm 6 passes. The upper 22 thus provided has a relatively continuous outer surface into which the flexion control device 5 is perfectly integrated. To perfect the continuity, a transverse projection 25 with a progressive profile is obtained on the shell base 1 opposite the edge 23 and spaced therefrom to allow for the possible evacuation of water and/or snow which would have infiltrated between the upper 22 and the shell base 1.

According to another embodiment, not shown, of the upper 22, an abutment limits the amplitude of its frontward pivoting 28 in addition to the abutment 26–27 which intervenes in rearward pivoting. In this example of construction, it is the abutments that determine the maximum amplitude of the possible pivoting of the upper 22. It is understood that this pivoting amplitude is advantageously limited to that of the elastic deformation acceptable by the shock absorbing element 7.

The description presented above with reference to FIGS. 1–6 shows the implementation of a flexion control device 5 whose viscoelastic shock absorbing element 7 is fixed on the shell base 1 in the heel zone, and whose transmission arm 6 is affixed to the top portion 8 of the upper 2, 22. It is to be understood that this flexion control device 5 can also be mounted in the reverse, i.e., by fixing the shock absorbing element 7 on the top portion 8 of the upper 2, 22, and the transmission arm 6 on the shell base 1 in the heel zone. In such example of construction, the flexion control device 5 still transmits the biases that are applied on the top portion 8 of the upper 2, 22, directly to the shock absorbing element 7 which remains constrained to operate in shearing due to its attachment on the free end of the transmission arm 6 which is then affixed to the shell base 1.

Another example of possible implementation of the flexion control device 5 of the upper 2, 22, with respect to the shell base 1 includes connecting each of the ends 11 and 12 of the transmission arm 6 to a viscoelastic shock absorbing element 7, one end fixed on the upper 2, 22, and the other end fixed on the shell base 1.

The instant application is based upon French Patent Application no. 95.04859, filed on Apr. 19, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A ski boot comprising;

a shell base;

an upper extending above said shell base, said upper including a top portion, said upper and said shell base being adapted to receive a lower portion of a skier's leg;

a pivotal connection between said upper and said shell base to enable pivotal movement of said upper with respect to said shell base;

a flexion control device to control said pivotal movement of said upper with respect to said shell base, said flexion control device comprising:

a transmission arm, said transmission arm having a first end and a second end, said transmission arm extending between said first end and said second end from said top portion of said upper to said shell base; and at least one block of elastically deformable viscoelastic material having at least two substantially parallel surfaces, one of said substantially parallel surfaces of said block being affixed to one of said first and second ends of said transmission arm and a second of said substantially parallel surfaces of said block being affixed to one of said shell base and said top portion of said upper, said block thereby being sandwiched between (A) one of said first and second ends of said transmission arm and (B) one of said shell base and said top portion of said upper.

2. A ski boot according to claim 1, wherein:

said first end of said transmission arm is an upper end and said second end of said transmission arm is a lower end; and said block of elastically deformable viscoelastic material is affixed to said lower end of said transmission arm and to said shell base.

3. A ski boot according to claim 1, wherein:

said block of elastically deformable viscoelastic material has a periphery extending around said block, said periphery being completely exposed during movement of said upper with respect to said shell base.

4. A ski boot according to claim 2, wherein:

said block of elastically deformable viscoelastic material has a periphery extending around said block, said periphery being completely exposed.

5. A ski boot according to claim 2, wherein:

said upper and said shell base comprise respective rear surfaces;

said transmission arm extends substantially parallel to said rear surfaces of said upper and said shell base, said upper end of said transmission arm being rigidly affixed to said top portion of said upper, and said lower end of said transmission arm being spaced from said rear surface of said shell base; and said block of elastically deformable viscoelastic material is positioned between said lower end of said transmission arm and said rear surface of said shell base.

6. A ski boot according to claim 1, wherein:

said pivotal connection between said upper and said shell base comprises a connection enabling forward and rearward pivotal movement of said upper with respect to said shell base; and said upper comprises a first abutment and said shell base comprises a second abutment, said first abutment and said second abutment being positioned for abutting contact for limiting said rearward pivotal movement at a predetermined position of said upper.

7. A ski boot according to claim 2, wherein:

said pivotal connection between said upper and said shell base comprises a connection enabling forward and rearward pivotal movement of said upper with respect to said shell base; and said upper comprises a first abutment and said shell base comprises a second abutment, said first abutment and said second abutment being positioned for abutting contact for limiting said rearward pivotal movement at a predetermined position of said upper.

8. A ski boot according to claim 1, wherein:

said pivotal connection between said upper and said shell base comprises a connection enabling forward and rearward pivotal movement of said upper with respect to said shell base; and said upper and said shell base comprise respective abutments being positioned for abutting contact for limiting said forward and rearward pivotal movement at respective predetermined positions of said upper.

9. A ski boot according to claim 2, wherein:

said pivotal connection between said upper and said shell base comprises a connection enabling forward and rearward pivotal movement of said upper with respect to said shell base; and said upper and said shell base comprise respective abutments being positioned for abutting contact for limiting said forward and rearward pivotal movement at respective predetermined positions of said upper.

10. A ski boot according to claim 2, wherein:

said transmission arm has a generally "T" shape with an upper horizontal bar and a lower vertically extending bar, said horizontal bar having laterally spaced ends each affixed to a respective lateral side of said upper, said lower vertically extending bar having a lower end constituted by said lower end of said transmission arm affixed to said block of elastically deformable viscoelastic material.

11. A ski boot according to claim 3, wherein:

said transmission arm has a generally "T" shape with an upper horizontal bar and a lower vertically extending bar, said horizontal bar having laterally spaced ends each affixed to a respective lateral side of said upper, said lower vertically extending bar having a lower end constituted by said lower end of said transmission arm affixed to said block of elastically deformable viscoelastic material.

12. A ski boot according to claim 5, wherein:

said transmission arm has a generally "T" shape with an upper horizontal bar and a lower vertically extending bar, said horizontal bar having laterally spaced ends each affixed to a respective lateral side of said upper, said lower vertically extending bar having a lower end constituted by said lower end of said transmission arm affixed to said block of elastically deformable viscoelastic material.

13. A ski boot according to claim 2, wherein:

said upper further comprises a lower portion, said lower portion including an enveloping edge, said enveloping edge masking said block of elastically deformable viscoelastic material and said lower end of said transmission arm, said lower end of said transmission arm extending through an upper opening formed by said enveloping edge.

14. A ski boot according to claim 3, wherein:

said upper further comprises a lower portion, said lower portion including an enveloping edge, said enveloping edge masking said block of elastically deformable viscoelastic material and said lower end of said transmission arm, said lower end of said transmission arm extending through an upper opening formed by said enveloping edge.

15. A ski boot according to claim 5, wherein:

said upper further comprises a lower portion, said lower portion including an enveloping edge, said enveloping edge masking said block of elastically deformable viscoelastic material and said lower end of said transmission arm, said lower end of said transmission arm extending through an upper opening formed by said enveloping edge.

16. A ski boot according to claim 6, wherein:

said upper further comprises a lower portion, said lower portion including an enveloping edge, said enveloping edge masking said block of elastically deformable viscoelastic material and said lower end of said transmission arm, said lower end of said transmission arm extending through an upper opening formed by said enveloping edge.

17. A ski boot according to claim 8, wherein:

said upper further comprises a lower portion, said lower portion including an enveloping edge, said enveloping edge masking said block of elastically deformable viscoelastic material and said lower end of said transmission arm, said lower end of said transmission arm extending through an upper opening formed by said enveloping edge.

18. A ski boot according to claim 1, wherein:

said pivotal connection between said upper and said shell base is constituted by connections between said upper and said shell base on opposite lateral sides of said ski boot.

19. A ski boot according to claim 6, wherein:

said first and second abutments are positioned between said transmission arm and rear surfaces of said upper and shell base.

20. A ski boot comprising:

a shell base;

an upper extending above said shell base, said upper including a top portion, said upper and said shell base being adapted to receive a lower portion of a skier's leg;

a pivotal connection between said upper and said shell base to enable pivotal movement of said upper with respect to said shell base;

a flexion control device to control said pivotal movement of said upper with respect to said shell base, said flexion control device comprising:

a transmission arm, said transmission arm having a first end and a second end, said transmission arm extending between said first end and said second end from said top portion of said upper to said shell base; and shock absorption material sandwiched between (A) one of said first and second ends of said transmission arm and (B) one of said shell base and said top portion of said upper, said shock absorption material comprising means subjected to a shearing force for absorbing shocks during said pivotal movement between said upper and said shell base.

21. A ski boot according to claim 20, wherein:

said shock absorption material is block of viscoelastic material rigidly secured to said transmission arm and rigidly secured to said shell base.

22. A ski boot according to claim 21, wherein:

said flexion control device is positioned at a rear of said shell base and a rear of said shell base.

* * * * *